US005243838A

United States Patent [19]

Ide et al.

[11] Patent Number: 5,243,838

[45] Date of Patent: Sep. 14, 1993

[54] REFRIGERANT SHUNT

[75] Inventors: Shinichi Ide, Muko; Teruhiko Taira; Koichi Nakayama, both of Kusatsu, all of Japan

[73] Assignee: Matsushita Refrigeration Company, Osaka, Japan

[21] Appl. No.: 950,749

[22] PCT Filed: Aug. 6, 1990

[86] PCT No.: PCT/JP90/01005

§ 371 Date: Apr. 11, 1991

§ 102(e) Date: Apr. 11, 1991

[87] PCT Pub. No.: WO91/02931

PCT Pub. Date: Mar. 7, 1991

Related U.S. Application Data

[63] Continuation of Ser. No. 674,326, Apr. 15, 1991, abandoned.

[30] Foreign Application Priority Data

Aug. 18, 1989 [JP] Japan ..... 1-213329
Aug. 18, 1989 [JP] Japan ..... 1-213330

[51] Int. Cl.[5] ..... F25B 39/02
[52] U.S. Cl. ..... 62/527; 62/504
[58] Field of Search ..... 62/527, 504, 525, 524, 62/117

[56] References Cited

U.S. PATENT DOCUMENTS

| | | | |
|---|---|---|---|
| 266,160 | 10/1882 | Johnson | 62/527 |
| 2,082,403 | 6/1937 | Larkin | 62/504 |
| 2,084,755 | 6/1937 | Young | 62/525 |
| 2,144,898 | 1/1939 | Shrode | 62/504 |
| 2,193,696 | 3/1940 | Ramsaur | 62/525 |
| 2,637,985 | 5/1953 | Ray | 62/504 |
| 2,722,809 | 11/1955 | Morrison | 62/504 |
| 3,864,938 | 2/1975 | Hayes, Jr. | 62/525 |
| 4,324,112 | 4/1982 | Fujiwara et al. | 62/527 |
| 4,593,539 | 6/1986 | Humpolik et al. | 62/527 |

*Primary Examiner*—Albert J. Makay
*Assistant Examiner*—William C. Doerrler
*Attorney, Agent, or Firm*—Wenderoth, Lind & Ponack

[57] ABSTRACT

A refrigerant shunt comprising an approximately cylindrical shunt portion which is provided at its one end with an inlet portion for forming a throttle, and at its other end with a collision wall for changing the flowing direction from the inlet portion, a plurality of output pipes which are radially spliced with the above described shunt portion peripheral wall, so that the vapor phase and the liquid phase of the refrigerant flowing into the inlet portion are uniformly mixed and also, are equally branched in flowing.

20 Claims, 12 Drawing Sheets

FIG. 1 - PRIOR ART

FIG. 2 - PRIOR ART

FIG. 3 - PRIOR ART

FIG. 4 - PRIOR ART

REFRIGERANT SHUNT

This application is a continuation of now abandoned application, Ser. No. 07/674,326 filed on Apr. 15, 1991.

ART FIELD TO THE INVENTION

The present invention generally relates to a refrigerant shunt or refrigerant diverter for equally shunting the refrigerant in a refrigerating cycle for an air conditioner or a refrigerator.

BACKGROUND ART

In recent years, in order to cope with the multiplication of the refrigerating system, and a plurality of circuits accompanied by the thinner diameter of the heating pipe of the heat exchanger, the refrigerant shunt is used, thus increasing in its importance.

Among the above described refrigerant shunts, copper made products are used, because they are more compacter, lower at cost, and easier to manufacture and mount The above described conventional refrigerant shunt will be described hereinafter with reference to the drawings.

FIG. 1 and FIG. 2 show the shape of the conventional refrigerant shunt. FIG. 3 shows the condition of mounting the refrigerant shunt on the heat exchanger. FIG. 4 shows the refrigerant condition within the refrigerant shunt with the heat exchanger being operated in the refrigerating cycle. Referring to FIG. 1 through FIG. 4, a refrigerant shunt 1 is composed of a fluid inlet pipe 4 which is provided at its one end with a fluid inlet opening 2 and at its other end with a fluid outlet opening 3, a conical barrel 5 and a cylindrical barrel 6 continuous to the inlet pipe, and further, a plurality of fluid outlet pipes 9 each being provided at its one end with a fluid inlet opening 7 and at its other end with a fluid outlet opening 8. Reference numeral 10 is a branch portion of the refrigerant.

A heat exchanger 11 constitutes refrigerant circuits with refrigerant pipes 12. The shunt 1 is mounted on the side of the heat exchanger 11 so as to form a plurality of refrigerant circuits.

The refrigerant shunt composed as hereinabove described will be described hereinafter in its operation with reference to FIG. 3 and FIG. 4.

The refrigerant A which flows through the refrigerating cycle, when it flows into the heat exchanger 11, flows into the shunt 1 which is above it, is branched, and is flowed into a plurality of refrigerant circuits composed of the refrigerant pipes 12. In the shunt 1, the refrigerant A which becomes two phase flows of a vapor phase A1 and a liquid phase A2, and is flowed from the fluid inlet opening 2 passes through the fluid inlet pipe 4, thereafter passes through the conical barrel 5, the cylindrical barrel 6. It is shunted into a plurality of fluid outlet pipes 9*a*, 9*b* in the branch portion 10. They flows out respectively into the refrigerant pipes 12*a*, 12*b* through the fluid outlet openings 8*a*, 8*b*. At this time, some portions of the refrigerant A does not flow out smoothly from the fluid outlet pipes 9*a*, 9*b*. Some portions of the liquid phase A2 collide, fall against the upper portion wall face of the cylindrical barrel 6, remain, circulate in the lower portion of the conical barrel 5 or the cylindrical barrel 6 so as to form the stagnant liquid. Similarly, some portions of the vapor phase A1 stay, circulate in the upper portion of the cylindrical barrel 6 so as to form the stagnant vapor.

In the above described construction, the refrigerant A is separated between the vapor and liquid with the vapor liquid proportion being unequal in the section thereof when it flows into the fluid inlet pipe 4 of the shunt 1. This condition continues even while it passes through the conical barrel 5 and the cylindrical barrel 6. The liquid face of the stagnant liquid is stirred by the inflowing two phase flows, with even the liquid phase amount to be accompanied from the liquid face becoming unequal. When the shunt 1 has been set to become inclined with respect to the vertical, the liquid phase A2 stayed within the shunt 1 flows more into the fluid outlet pipe 9 of the vertical bottom portion. Therefore, a problem is provided in that the equal branch flowing of the refrigerant A weight into the fluid outlet pipes 9*a*, 9*b* and further the refrigerant pipes 12*a*, 12*b* continuous to them cannot be provided in the branch portion 10.

The shunt 1 has a problem in that it necessarily becomes larger in size and higher in cost, because a plurality of fluid inlet pipes 9 are connected with one end thereof.

HOW TO SOLVE PROBLEMS OF PRIOR ART BY THE INVENTION

Accordingly, an essential object of the present invention is to provide a refrigerant shunt, which is capable of accelerating the refrigerants, which flow into the fluid inlet portion, by the throttling operation thereof, colliding them against the collision wall so as to sufficiently mix uniformly the refrigerants in the vapor phase state with the refrigerants in the liquid phase state.

Another important object of the present invention is to provide a refrigerant shunt, which is capable of almost removing the stagnant liquid, the stagnant vapor causing portions from the branch flowing portions so as to make it possible to effect the equal branch flows into the fluid outlet pipe.

A further object of the present invention is to provide a refrigerant shunt, which is capable of radially splicing the fluid inlet pipes with the shunt portion peripheral wall so as to make the size smaller, the cost lower with respect to the conventional refrigerant shunt.

In accomplishing these and other objects, according to one preferred embodiment of the present invention, there is provided a refrigerant shunt which is provided at its one end with a fluid inlet portion forming a throttle, and at its other end with an approximately cylindrical shunt portion having a collision wall for changing the flowing direction from the inlet portion, and a plurality of fluid outlet pipes which are radially connected with the above described shunt portion peripheral walls.

BRIEF DESCRIPTION OF THE DRAWINGS

These and other objects and features of the present invention will become apparent from the following description taken in conjunction with the preferred embodiment thereof with reference to the accompanying drawings, in which.

BEST EMBODIMENTS TO BE EXPLOITED BY THE INVENTION

Figure 1:
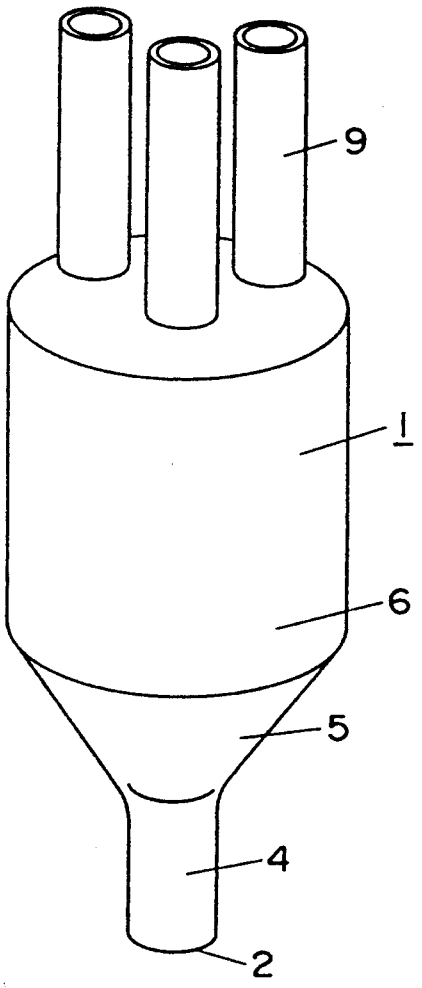
FIG. 1 is a perspective view of the conventional refrigerant shunt.
Figure 2:
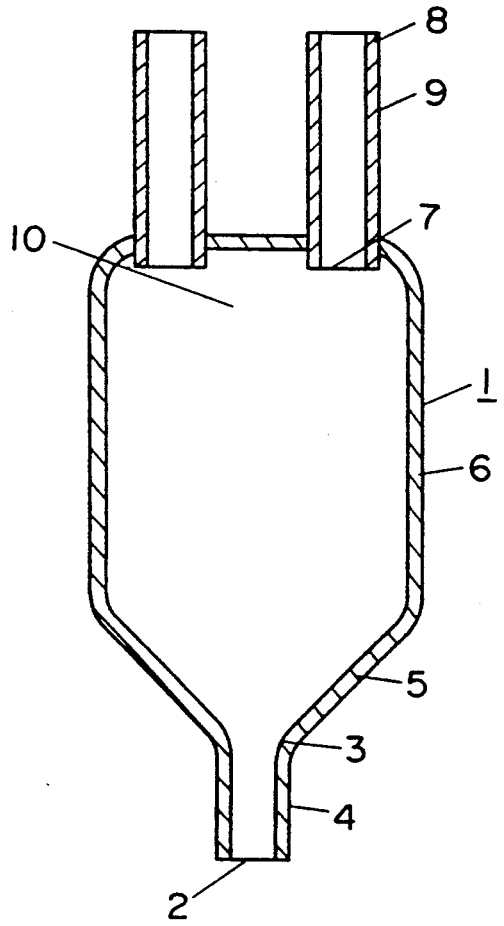
FIG. 2 is a sectional view of a refrigerant shunt shown in FIG. 1.
Figure 3:
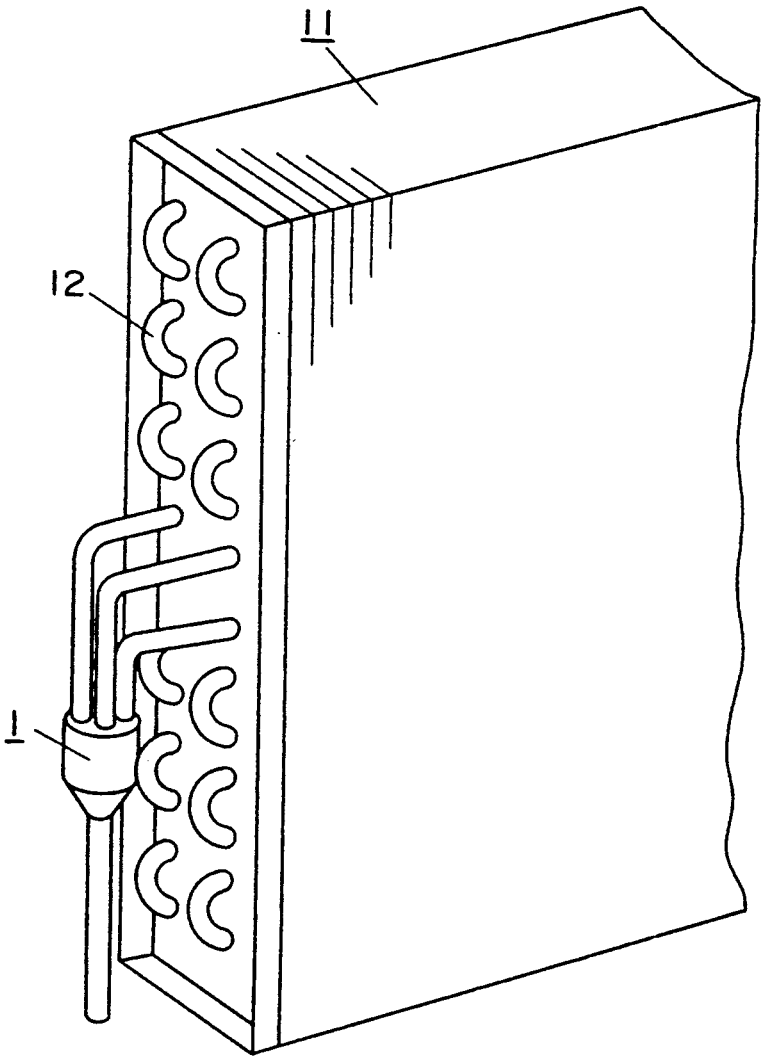
FIG. 3 is a perspective view showing how a refrigerant shunt shown in FIG. 1 is mounted onto a heat exchanger.
Figure 4:
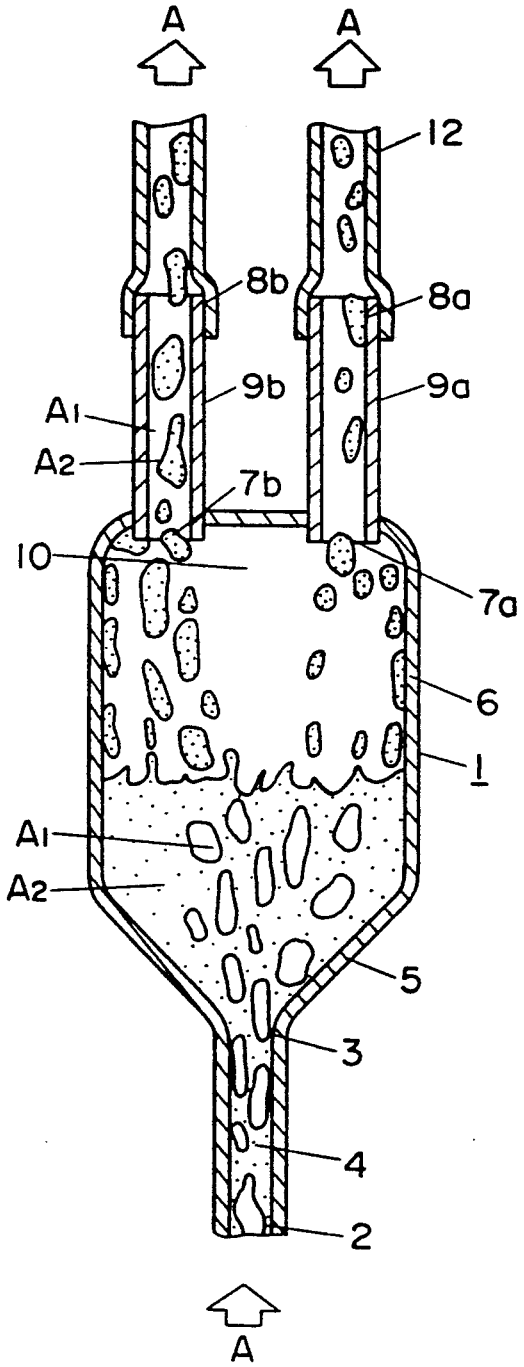
FIG. 4 is a sectional view showing the flowing of the refrigerants in the using condition of the refrigerant shunt shown in FIG. 1.

Before the description of the present invention proceeds, it is to be noted that like parts are designated by like reference numerals throughout the accompanying drawings.

The refrigerant shunts in the embodiments of the present invention will be described hereinafter with reference to the drawings.

Figure 5:
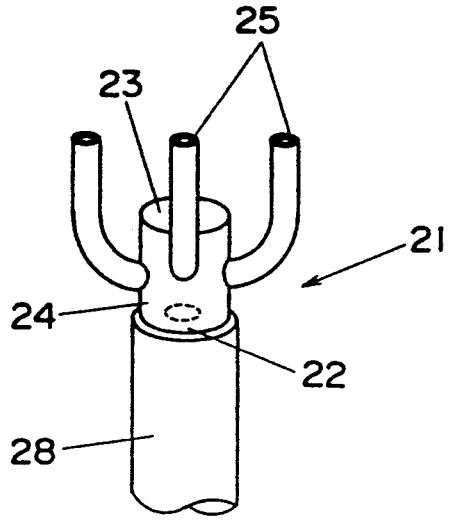
FIG. 5 is a perspective view of a refrigerant shunt in a first embodiment of the present invention.
Figure 6:
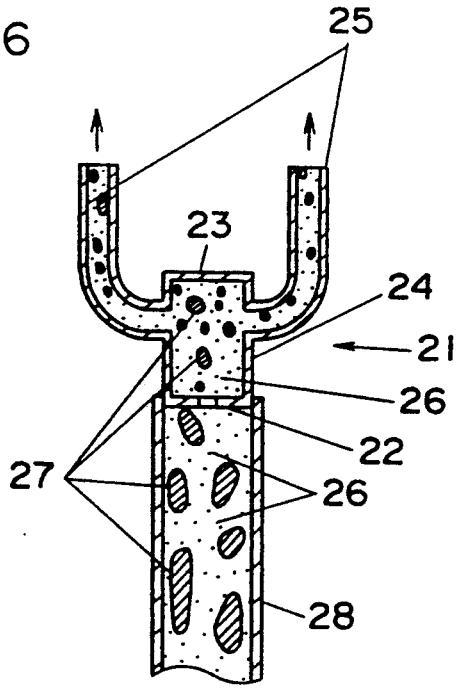
FIG. 6 is a sectional view in the using condition of a refrigerant shunt shown in FIG. 5.
Figure 7:
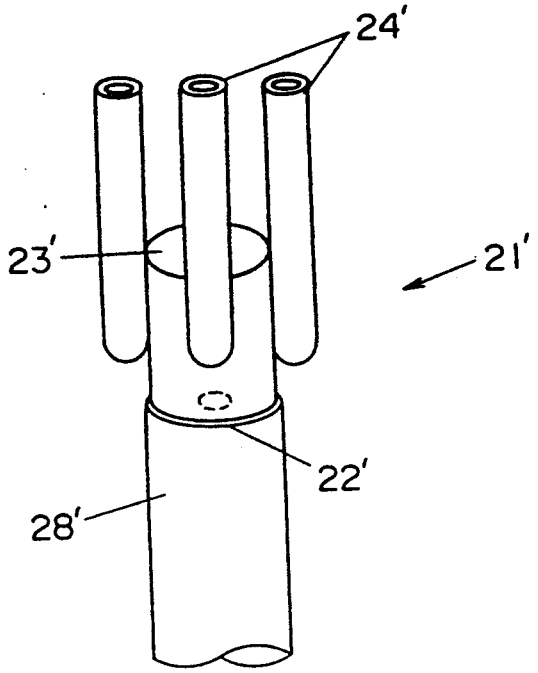
FIG. 7 is a perspective view of a refrigerant shunt in a second embodiment of the present invention.
Figure 8:
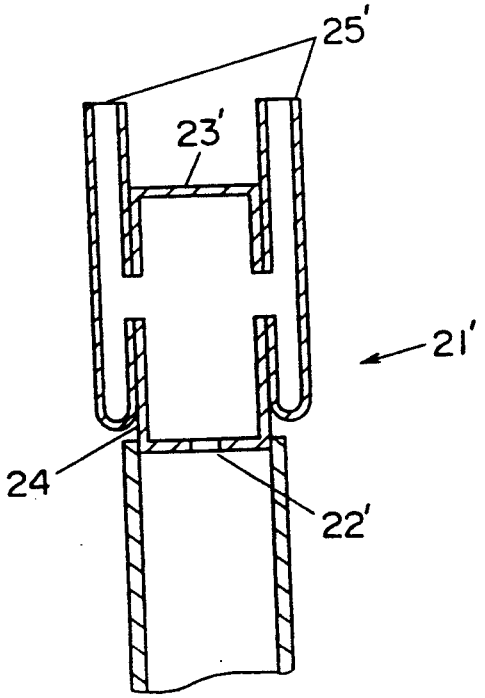
FIG. 8 is a sectional view of a refrigerant shunt shown in FIG. 7.

FIG. 5 shows the using condition appearance of a refrigerant shunt in a first embodiment of the present invention, with FIG. 6 showing the sectional view thereof. FIG. 7 shows a second embodiment of the present invention, with FIG. 8 showing the sectional view thereof. In FIG. 5 through FIG. 8, there are shown refrigerant shunts 21, 21', fluid inlet portions 22, 22' forming the throttles, collision walls 23, 23' disposed on the opposite faces of the fluid inlet portions 22, 22,, approximately cylindrical shunt portions 24, 24', a plurality of fluid outlet pipes 25, 25' spliced radially with the peripheral walls of the approximately cylindrical shunt portions 24, 24'. The fluid inlet pipes 28, 28' are mounted in the actual use.

The refrigerant shunts 21, 21' constructed hereinabove will be described hereinafter in the operation thereof.

Both the first embodiment and the second embodiment will be similar in the operations thereof. The first embodiment will be described with the use of FIG. 6. The refrigerants flowing through the refrigerant shunt 21 are in the condition of two phase flows of the vapor phase 26 and the liquid phase 27. They enter from the fluid inlet portion 22 forming the throttle, is branched in flowing into the fluid outlet pipe 25 and goes out. In the portion of the fluid inlet pipe 28 before the refrigerant flows into the refrigerant shunt 21, the two phase flows which exist unequally in the vapor phase 26 and the liquid phase 27 are mixed in the passing operation through the fluid inlet portion 22 forming the throttle and are accelerated in the flowing. By the collision thereof against the collision wall 23, the above described two phase flows are sufficiently mixed uniformly, are radially spread along the collision wall 23, and are branched in flowing into the fluid outlet pipe 25 spliced radially with the peripheral wall of the approximately cylindrical shunt portion 24. At this time, as the portions where the stagnant liquid, the stagnant vapor are formed hardly exist within the shunt portion 24, the mixing condition of the refrigerants remains uniformed with the mixing effects of the vapor phase 26 and the liquid phase 27 by the collision against the throttle, so that it is equally branched in flowing.

Since the fluid outlet pipe 25 is adapted to be connected radially with the peripheral wall of the approximately cylindrical shunt portion 24, it is possible to make the size smaller, the cost lower with respect to the conventional refrigerant shunt 21. Especially in the second embodiment, the size may be sharply made smaller.

According to the first and second embodiments, the refrigerant shunt is provided at its one end with fluid inlet portions 22, 22' for forming the throttles, and at its other end with an approximately cylindrical shunt portions having the collision walls 23, 23' for changing the direction of the flowing from the respective inlet portions 22, 22' and a plurality of fluid outlet pipes 25, 25' spliced radially with the peripheral walls of the above described approximately cylindrical shunt portions 24, 24' peripheral walls, so that not only the equal branch followings, but also the smaller size, the lower cost may be realized.

Figure 9:
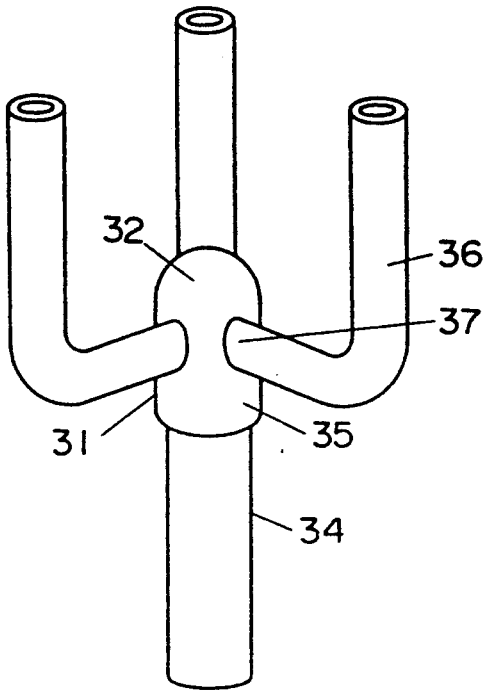
FIG. 9 is a perspective view of a refrigerant shunt in a third embodiment of the present invention.
Figure 10:
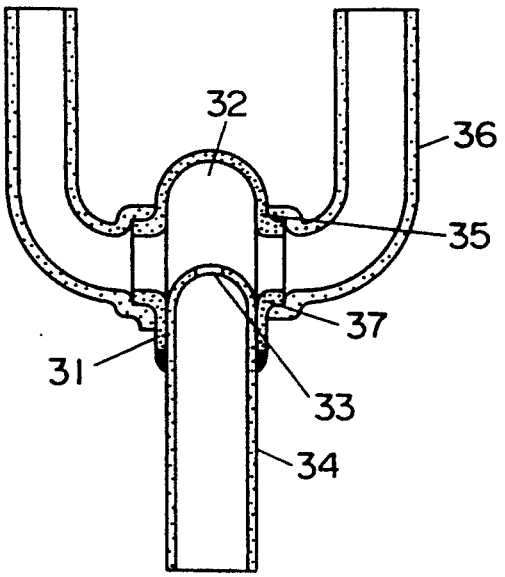
FIG. 10 is a sectional view of a refrigerant shunt shown in FIG. 9.
Figure 11:
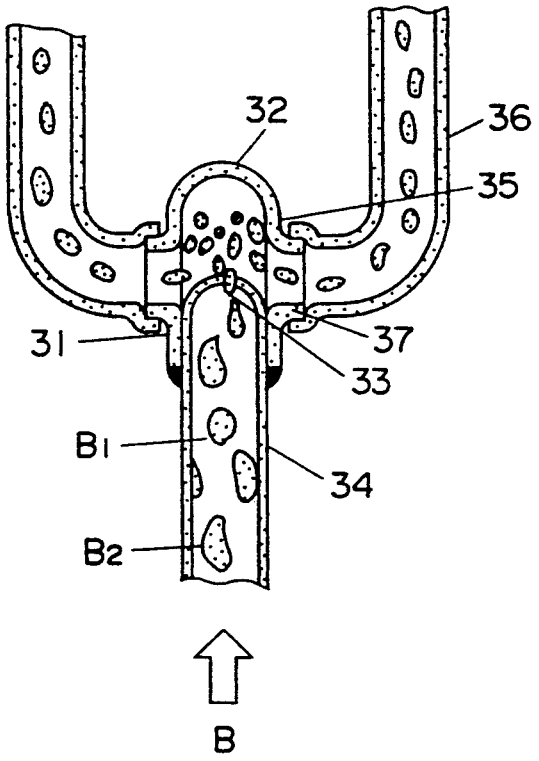
FIG. 11 is a sectional view showing the flowing of the refrigerants in the using condition of the refrigerant shunt shown in FIG. 9.

FIG. 9 through FIG. 10 show the shape of a refrigerant shunt in a third embodiment of the present invention. FIG. 11 shows the refrigerant condition within the refrigerant shunt when the heat exchanger has been operated in the refrigerator cycle. In FIG. 9 through FIG. 11, a refrigerant shunt 31 is provided at its one end with an approximately dome-shaped collision wall 32, and at its other end with a shunt portion 35 which has a fluid inlet pipe 34 having a small hole 33 for jetting the refrigerants with respect to the collision wall 32, and a plurality of fluid outlet pipe 36 disposed radially on the wall face of the above described shunt portion 35. The fluid outlet pipe mounting hole portion 37 of the above described shunt portion 35 is treated in the edge erection and the fluid outlet pipe 36 is engaged with the outside of the edge erection treating.

The fluid inlet pipe 34 is engaged into the inflow opening of the shunt portion 35 so that the distance from the small hole 33 of the fluid inlet pipe 34 to the deepest portion of the collision wall 32 may become shorter than the maximum value of the distance from the pipe wall of the fluid outlet pipe 36 to the deepest potion of the collision wall 32.

The refrigerant B which flows through the refrigerating cycle becomes the two phase flows of the vapor phase B1 and the liquid phase B2, and passes through the small hole 33 to flow into the refrigerant shunt 31 from the fluid inlet pipe 34. At this time, the above described two phase flows become a jet in which the vapor phase B1 has been mixed with the liquid phase B2 by the throttling operation of the small hole 33. Thereafter, the jetted refrigerants collide against the approximately dome-shaped collision wall 32 of the opposite face, and is further mixed in the vapor and the liquid by the collision mixing effect.

In the interior of the refrigerant shunt 31, the vapor and the liquid are uniformly mixed. The equalized refrigerant B is radially spread along the approximately dome-shaped collision wall 32, and is separated, flowed out into a fluid outlet pipe 36 mounted on the shunt portion 35. At this time, the volume within the refrigerant shunt 31 is small, the stagnant liquid and the stagnant vapor are hardly formed within the refrigerant shunt 31. The refrigerant B is equally separated, and flows out into the fluid outlet pipe 36 with the above described vapor and the liquid remaining uniformly mixed. Since the the collision wall 32 is approximately dome-shaped, the fluid outlet pipe mounting hole portion 37 is treated in the edge erection, and the fluid outlet pipe 36 is treated on the outer side of the edge erection treatment, the refrigerant B is separated, flows out equally without any hindrance from the collision to the flow out.

According to the present embodiment, the small hole 33 is provided in the fluid inlet pipe 34, the collision wall 32 for receiving the outlet jet thereof is made dome-shaped, and the inner volume of the refrigerant shunt 31 is adapted to be made smaller, so that two phases of the vapor and the liquid of the refrigerant B within the refrigerant shunt 31 are uniformly mixed, and may be equally branched into the fluid outlet pipe 36 with the uniform condition being retained.

Since the fluid inlet pipe 34 is engaged into the inlet opening of the shunt portion 35 so that the distance from the small hole 33 of the inlet pipe 34 to the deepest portion of the collision wall 32 may become shorter than the maximum value of the distance from the pipe wall of the fluid inlet pipe 36 to the deepest portion of the collision wall 32, the refrigerants may be prevented from flowing directly into the one fluid outlet pipe 36 because of reduction in the flow speed of the refrigerants within the shunt portion 35, the creation of the stagnant liquid near the small hole 33 within the shunt portion 35, and the mounting distortion of the fluid inlet pipe 34 of the inlet opening of the shunt portion 35, which are caused by the longer distance from the small hole 33 of the fluid inlet pipe 34 to the deepest portion of the collision wall 32.

Figure 12:
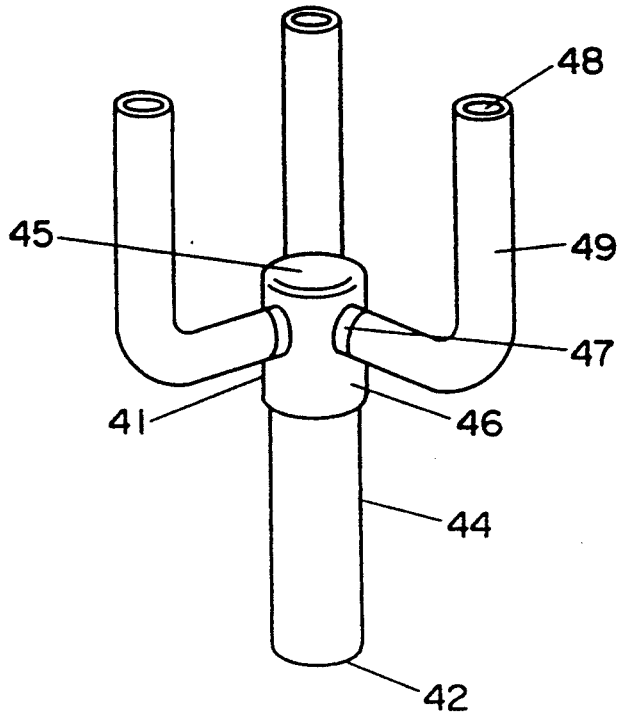
FIG. 12 is a perspective view of a refrigerant shunt in a fourth embodiment of the present invention.
Figure 13:
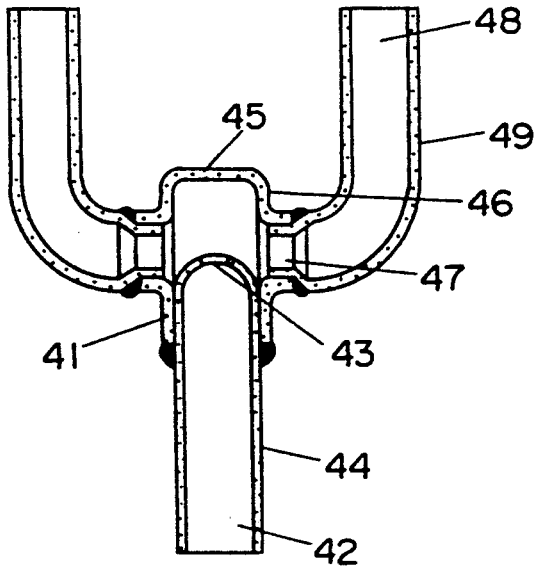
FIG. 13 is a sectional view of a refrigerant shunt shown in FIG. 12.
Figure 14:
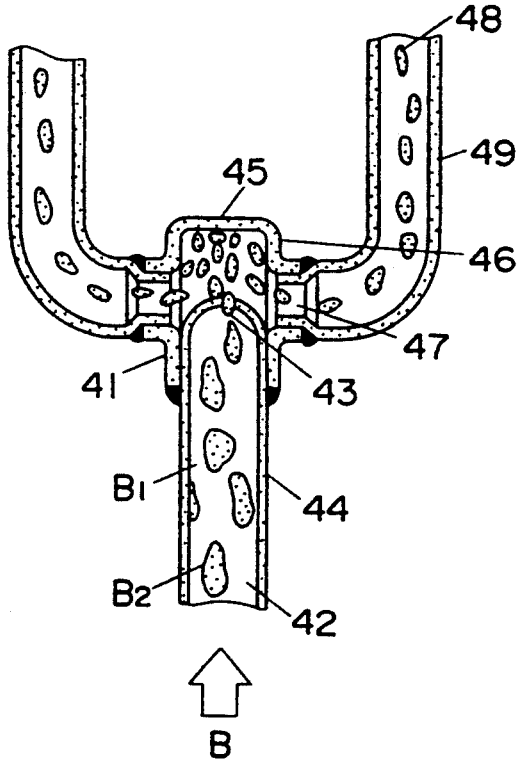
FIG. 14 is a sectional view showing the flowing of the refrigerants in the using condition of the refrigerant shunt shown in FIG. 12.

FIG. 12 and FIG. 13 show the shape of a refrigerant shunt in a fourth embodiment of the present invention. FIG. 14 shows the refrigerant condition within the refrigerant shunt in the refrigeration cycling operation of the heat exchanger. In FIG. 12 through FIG. 14, a refrigerant shunt 41 radially has a fluid inlet pipe pipe 44 which is provided at its one end with a fluid inlet opening 42, and at the other end with a small hole 43, a collision wall 45 for receiving the jet from the small hole 43, a peripheral wall 46 surrounding it, further a plurality of fluid inlet pipes 49 each being provided at its one end with a fluid inlet hole 47 with its inner diameter being narrowed, and at its other end with a fluid outlet 48, the fluid outlet pipes being mounted radially with respect to the central shaft of the refrigerant shunt 41.

Such a refrigerant shunt as constructed hereinabove will be described hereinafter in its operation with the use of FIG. 14.

The refrigerant B flowing through the closed circuit of the refrigerant cycle becomes two phase flows of the vapor phase B1 and the liquid phase B2, and flows into the refrigerant shunt 41 from the inlet opening 42. The refrigerant is jetted from the small hole 43 after passing through the fluid inlet pipe 44. At this time, the above described two phase flows are contracted . accelerated into the jet by the nozzle operation, and flows out. Thereafter, the jet of the refrigerant B collides against the top portion collision wall 45 and is stirred, mixed. The mixed condition of two phase flows of the vapor and the liquid of the refrigerant B is equalized by the colliding stirring mixing operations. The equalized refrigerant B is spread radially along the top portion collision wall 45, flows out and separately flows into the inlet opening 47 of the fluid outlet pipe 49 mounted on the peripheral wall 46. At this time, the stagnant liquid and the stagnant vapor are not formed within the volume surrounded by the collision wall 45 and the peripheral wall 46. The vapor, liquid mixed condition of the refrigerant B remains uniform by the above described nozzle effect. As the inner diameter of the inlet opening 47 is narrowed, the uniformed two phase flows are jetted by the throttling effect, so that the separate flowing into the respective fluid outlet pipes 49 are equalized. Since the separate flowing is not required to be improved by the rearward resistance by the fluid outlet pipe 49, the fluid outlet pipe 49 and the refrigerant pipe (not shown) continuous to it may be made larger in the inner diameter, so that the pressure loss may be reduced.

According to the present embodiment, the small hole 43 is provided in the fluid inlet pipe 44, the volume surrounded by the the collision wall 45 and the peripheral wall 46 for receiving the inlet jet is made smaller so that the stagnant liquid and the stagnant vapor may not be formed, so that the mixed condition of the two phase flows of the vapor and the liquid of the refrigerant B flowed into the refrigerant shunt 41 may be equalized and may be retained. Further, as the equalized two phase flows are jetted by the throttling effect of the inlet opening 47 of each fluid outlet pipes 49, the separate flowing of the refrigerants into each fluid outlet pipe 49 and a refrigerant pipe (not shown) continuous to it may be equally made closer.

Figure 15:
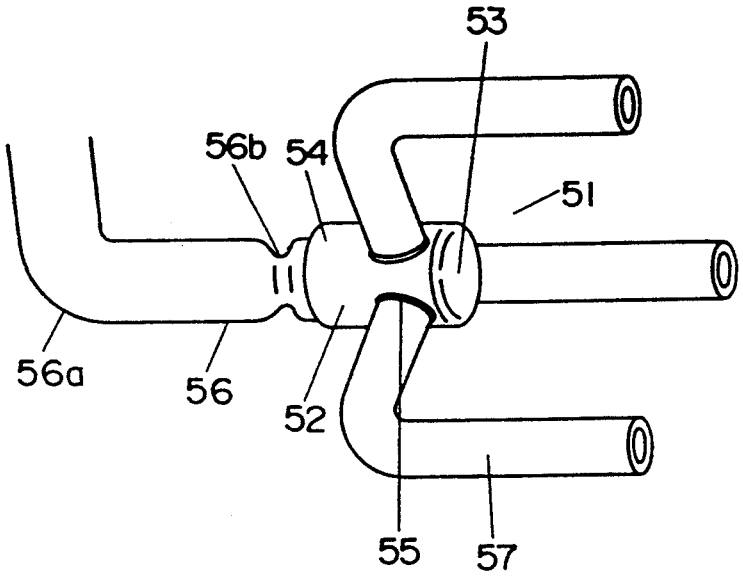
FIG. 15 is a perspective view of a refrigerant shunt in a fifth embodiment of the present invention.
Figure 17:
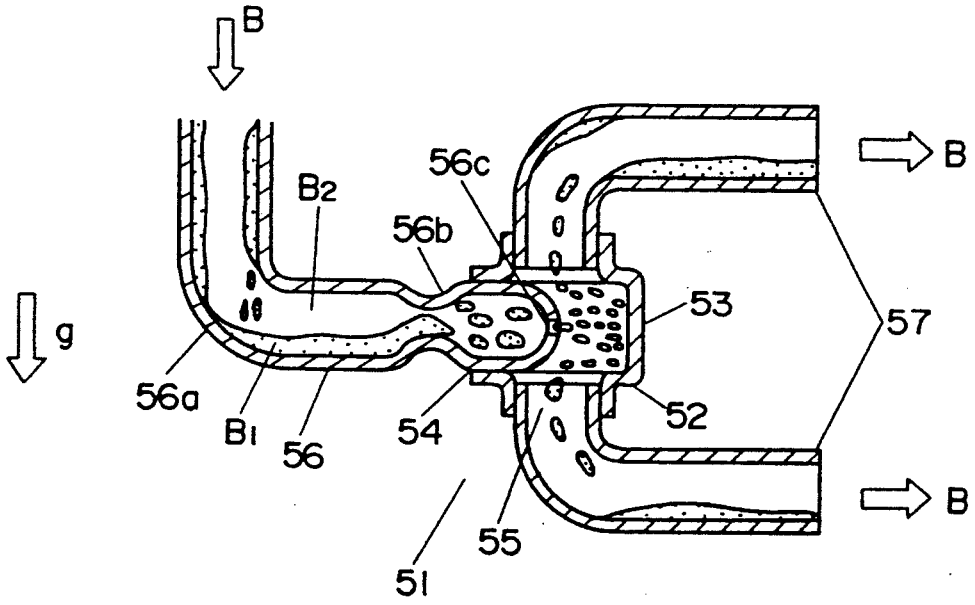
FIG. 17 is a sectional view showing the flowing of the refrigerants in the using condition of the refrigerant shunt shown in FIG. 15.

FIG. 15 shows an outer appearance of the refrigerant shunt in the embodiment of the present invention. FIG. shows the sectional view thereof. FIG. 17 is a refrigerant condition within the refrigerant shunt with the heat exchanger being used as an evaporator in the refrigerating cycle operation.

Figure 16:
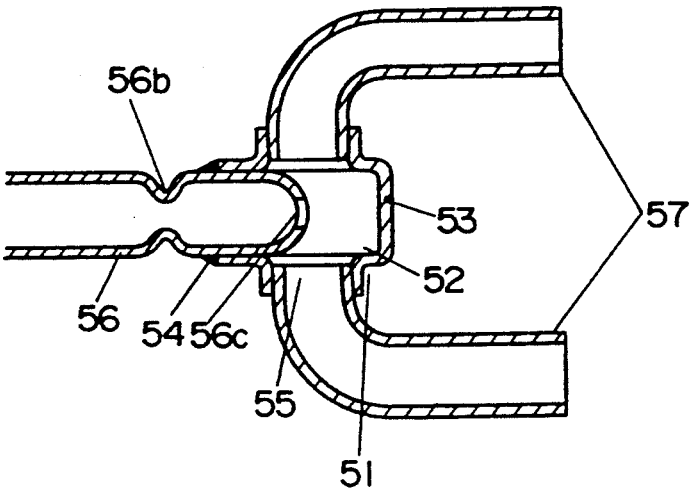
FIG. 16 is a sectional view of a refrigerant shunt shown in FIG. 15.

In FIG. 15 through FIG. 17, the refrigerant shunt 51 has a cylindrical shunt portion 52 which is provided at its one end with a collision wall 53, at its other end with a refrigerant fluid inlet opening 54, and with a plurality of outlet openings 55 on the peripheral wall. A fluid inlet pipe 56 is inserted into and spliced with the refrigerant inlet opening 54. The fluid inlet pipe 56 has a bent portion 56*a*, a small hole 56*c* at one end where the refrigerant flows out, and a throttle portion 56*b* near the small hole 56*c*. A fluid outlet pipe 57 is inserted into and spliced with the fluid outlet opening 55.

A refrigerant shunt constructed as described hereinabove will be described hereinafter in its operation with the use of FIG. 17.

The refrigerant B which flows through the closed circuit of the refrigerating cycle becomes two phase currents of the liquid phase B1 and the vapor phase B2 to pass through the fluid inlet pipe 56. At this time, the liquid phase B1 and the vapor phase B2 pass through the bent portion 56*a*, and thereafter is separated in the vapor and the liquid in an unequal condition, and is deflected under the influences of gravity g and the bent portion 56. Thereafter, the refrigerant B is contracted, accelerated in flow by the throttle portion 56*b* into the jet. The liquid phase B1 and the vapor phase B2 are mixed, are improved in the deflection and thereafter, are jetted into the shunt portion 52 by the small hole 56*c*. At this time, the refrigerant 17 is contracted, accelerated again into the jet and flows out by the nozzle effect, collides against the collision wall 53, and is stirred, mixed. The mixed condition of two phase flows of the vapor and the liquid of the refrigerant B is completely equalized by the colliding, stirring and mixing operations. The equalized refrigerant B is spread radially along the collision wall 56, and flows out into the fluid outlet pipe 57 from a plurality of outlet openings 55 of the peripheral wall of the shunt portion 52, thus completing the branch flowing operation.

At this time, as the inner volume of the shunt portion 52 is sufficiently smaller, the vapor and the liquid mixed condition of the refrigerant B remains equalized by the above described nozzle effect and collision effect. The refrigerant B is equally branched in flowing however the refrigerant shunt 51 is set in condition.

According to the present embodiment, a cylindrical shunt portion 52 which becomes a collision wall 56 at its one end, with the inner volume being made sufficiently smaller so that the stagnant liquid and the stagnant vapor may not be caused, a fluid inlet pipe 56 which is capable of relieving the drift flowing caused under the influences of the gravity g and the bent portion 56*a*, equally mixing the vapor and the liquid into the shunt portion 52 so as to flow into it through the provision of the small hole 56*c* in the outlet end, the throttle portion 56*b* in the vicinity portion of the above described outlet end, and a fluid outlet pipe 57 is provided on the periphery wall of the above described shunt portion 52, so that the equal branch flowing of the refrigerants may be effected however the refrigerant shunt 51 is set in condition. Also, although the throttle portion 56*b* of the fluid inlet pipe 56 is provided by one in the present embodiment, it is needless to say that the same effect is provided if the throttle portion 56*b* is provided by plurality.

INDUSTRIAL UTILITY PROBABILITY OF THE INVENTION

As is clear from the foregoing description, according to the arrangement of the present invention, a refrigerant shunt is provided at its one end with a fluid inlet portion forming a throttle, and at its the other end with an approximately cylindrical shunt portion having a collision wall for changing the flowing direction from the fluid inlet potion, and a plurality of fluid outlet pipes radially spliced with the above described shunt portion peripheral wall. The refrigerant which flows into the inlet portion is accelerated by the throttle, is collided against the collision wall, the refrigerant in the vapor phase state and the refrigerant in the liquid state are mixed sufficiently uniformly, also the equal separate flow into the fluid outlet pipe may be realized, so that the higher efficiency of the heat exchanger between the refrigerating apparatus and the air conditioner may be effected. Further, by the radial splicing of the outlet pipe with the shunt portion peripheral wall, the smaller size and the lower cost may be realized with respect to the conventional refrigerant shunt.

We claim:

1. A refrigerant shunt for mixing and distributing refrigerant, comprising:

an approximately cylindrical shunt portion having at a first end thereof an inlet opening and at a second end thereof opposite said first end an approximately dome-shaped collision wall, and having a peripheral wall with a plurality of outlet openings formed radially therein;

a jet provided in said inlet opening of said shunt portion, said jet comprising a small nozzle hole for jetting the refrigerant against said collision wall;

a plurality of fluid outlet pipes mounted to said shunt portion and extending from said plurality of outlet openings, respectively; and wherein said small nozzle hole of said jet is disposed closely adjacent said collision wall such that said jet and said collision wall together define a means for colliding refrigerant against said collision wall and causing stirring and mixing of said refrigerant.

2. A refrigerant shunt as recited in claim 1, further comprising a fluid inlet pipe engaged in said inlet opening; and wherein said small nozzle hole of said jet is formed in an outlet end of said fluid inlet pipe.

3. A refrigerant shunt as recited in claim 2, wherein portions of said outlet pipes respectively adjacent said outlet openings are narrowed relative to remaining portions of said outlet pipes, respectively.

4. A refrigerant shunt as recited in claim 2, wherein said outlet end of said fluid inlet pipe is approximately dome-shaped.

5. A refrigerant shunt as recited in claim 1, wherein said outlet openings are respectively defined by flanges projecting radially outwardly from said shunt portion; and said outlet pipes are respectively engaged about outer peripheries of said flanges.

6. A refrigerant shunt as recited in claim 1, further comprising a fluid inlet pipe engaged in said inlet opening; and wherein a portion of said inlet pipe adjacent its engagement with said shunt portion is formed with a narrowed throttling portion.

7. A refrigerant shunt as recited in claim 6, wherein said small nozzle hole of said jet is formed in an outlet end of said fluid inlet pipe.

8. A refrigerant shunt as recited in claim 1, wherein a distance from said nozzle hole of said jet to said collision all is shorter than a maximum distance from pipe walls of said outlet pipes, respectively, to said collision wall.

9. A refrigerant shunt as recited in claim 8, further comprising a fluid inlet pipe engaged in said inlet opening; and wherein said small nozzle hole of said jet is formed in an outlet end of said fluid inlet pipe.

10. A refrigerant shunt as recited in claim 1, wherein said fluid outlet pipes are mounted to said peripheral wall of said shunt portion at circumferentially spaced apart locations.

11. A refrigerant shunt for mixing and distributing refrigerant, comprising:

an approximately cylindrical shunt portion having at a first end thereof an inlet opening and at a closed second end thereof opposite said first end a collision wall, and having a peripheral wall with a plurality of outlet openings formed radially therein;

a jet provided in said inlet opening of said shunt portion, said jet comprising a small nozzle hole for jetting the refrigerant against said collision wall;

a plurality of fluid outlet pipes mounted to said shunt portion and extending from said plurality of outlet openings, respectively; and wherein said small nozzle hole of said jet is disposed closely adjacent said collision all such that said jet and said collision wall together define a means for colliding refrigerant against said collision wall and causing stirring and mixing of said refrigerant.

12. A refrigerant shunt as recited in claim 11, further comprising a fluid inlet pipe engaged in said inlet opening; and wherein said small nozzle hole of said jet is formed in an outlet end of said fluid inlet pipe.

13. A refrigerant shunt as recited in claim 12, wherein portions of said outlet pipes respectively adjacent said outlet openings are narrowed relative to remaining portions of said outlet pipes, respectively.

14. A refrigerant shunt as recited in claim 12, wherein said outlet end of said fluid inlet pipe is approximately dome-shaped.

15. A refrigerant shunt as recited in claim 11, wherein said outlet openings are respectively defined by flanges projecting radially outwardly from said shunt portion; and said outlet pipes are respectively engaged about outer peripheries of said flanges.

16. A refrigerant shunt as recited in claim 11, further comprising a fluid inlet pipe engaged in said inlet opening; and wherein a portion of said inlet pipe adjacent its engagement with said shunt portion is formed with a narrowed throttling portion.

17. A refrigerant shunt as recited in claim 16, wherein said small nozzle hole of said jet is formed in an outlet end of said fluid inlet pipe.

18. A refrigerant shunt as recited in claim 11, wherein a distance from said nozzle hole of said jet to said collision wall is shorter than a maximum distance from pipe walls of said outlet pipes, respectively, to said collision wall.

19. A refrigerant shunt as recited in claim 18, further comprising a fluid inlet pipe engaged in said inlet opening; and wherein said small nozzle hole of said jet is formed in an outlet end of said fluid inlet pipe.

20. A refrigerant shunt as recited in claim 11, wherein said fluid outlet pipes are mounted to said peripheral wall of said shunt portion at circumferentially spaced apart locations.

* * * * *